US007988003B1

(12) United States Patent
Clodfelter

(10) Patent No.: US 7,988,003 B1
(45) Date of Patent: Aug. 2, 2011

(54) RATCHET PUSH AND TURN CHILD RESISTANT CLOSURE

(75) Inventor: Christopher B. Clodfelter, Evansville, IN (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 534 days.

(21) Appl. No.: 12/100,601

(22) Filed: Apr. 10, 2008

Related U.S. Application Data

(60) Provisional application No. 60/952,008, filed on Jul. 26, 2007.

(51) Int. Cl.
*B65D 55/02* (2006.01)

(52) U.S. Cl. ..... 215/220

(58) Field of Classification Search ..... 215/220, 215/219, 218, 217, 201, 221, 228, 337, 329, 215/316, 200; 220/254.8, 254.1, 288, FOR. 203, 220/296, 298, 212, 301, 293, 200; D9/435
See application file for complete search history.

(56) References Cited

U.S. PATENT DOCUMENTS

| | | | | |
|---|---|---|---|---|
| 2,710,701 | A | 6/1955 | Hale | |
| 3,396,864 | A * | 8/1968 | Jones et al. | 215/215 |
| 3,622,027 | A | 11/1971 | Maki | |
| 3,692,199 | A | 9/1972 | Mumford | |
| 3,705,662 | A | 12/1972 | Gach | |
| RE027,837 | E | 12/1973 | McIntosh | |
| 3,795,337 | A | 3/1974 | Nozawa et al. | |
| 3,795,338 | A | 3/1974 | Swartzbaugh et al. | |
| 3,797,688 | A | 3/1974 | Porcelli et al. | |
| 3,809,272 | A | 5/1974 | Maki | |
| 3,812,990 | A | 5/1974 | Willis | |
| 3,830,390 | A | 8/1974 | Gach | |
| 3,853,236 | A | 12/1974 | Ostrowsky | |
| 3,950,917 | A | 4/1976 | Choksi et al. | |
| 4,037,747 | A * | 7/1977 | Acton et al. | 215/219 |
| 4,095,717 | A | 6/1978 | Michaelsen | |
| 4,364,484 | A | 12/1982 | Kinsley | |
| 5,147,052 | A * | 9/1992 | Minette | 215/215 |
| 5,370,251 | A | 12/1994 | Buono | |
| 5,579,934 | A * | 12/1996 | Buono | 215/220 |
| 2004/0262251 | A1 | 12/2004 | Tauber | |

FOREIGN PATENT DOCUMENTS

| | | |
|---|---|---|
| EP | 0026284 | 4/1981 |

* cited by examiner

*Primary Examiner* — Anthony Stashick
*Assistant Examiner* — Robert J Hicks
(74) *Attorney, Agent, or Firm* — Chad D. Bruggeman; John F. Salazar; Middleton Reutlinger

(57) ABSTRACT

A child resistant closure having a ratchet push and turn mechanism. The ratchet push and turn mechanism includes an over cap disposed over an under cap, each with ratchet teeth in operable engagement. The ratchet teeth of the closure may have a groove. Another groove may extend between adjacent ratchet teeth allowing air to escape from between the under cap and the over cap during the assembly process of the closure.

23 Claims, 6 Drawing Sheets

RATCHET PUSH AND TURN CHILD RESISTANT CLOSURE

CROSS-REFERENCE TO PRIOR APPLICATION

This application claims priority to U.S. Provisional Application No. 60/952,008, filed on Jul. 26, 2007, which is incorporated herein by reference.

TECHNICAL FIELD

The present invention relates to a child resistant closure in particularly to a ratchet push and turn closure for a container.

DETAILED DESCRIPTION

Figure 1:
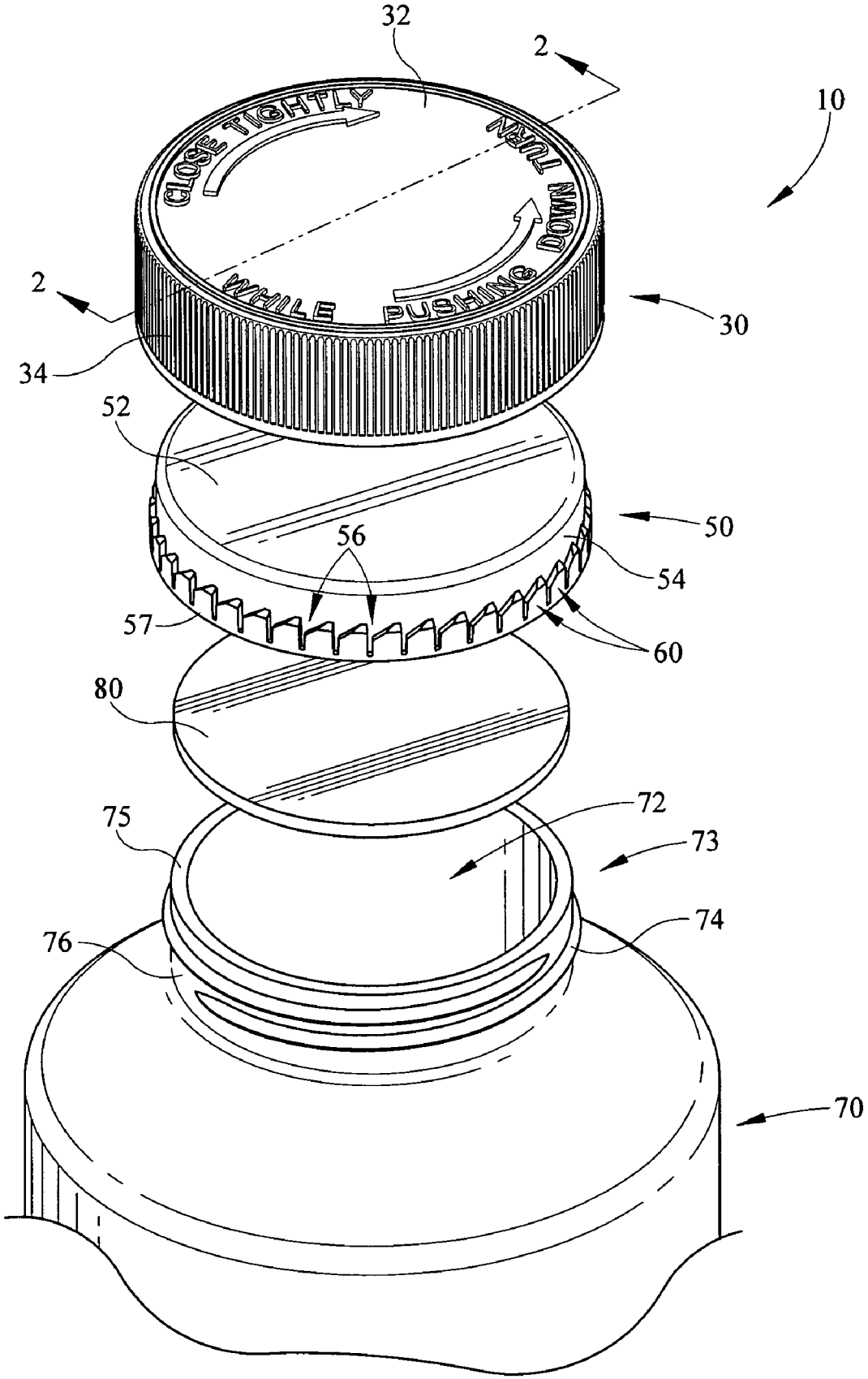
FIG. 1 is a perspective view of a ratchet push and turn closure embodiment with the container partially broken away and the closure exploded away from the container.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

A child resistant closure 10 according to one embodiment of the present invention depicted in the FIGS. 1-3B has an over cap 30 and an under cap 50 structured to provide at least one adequate child resistant mechanism. The child resistant mechanism discourages access to the contents of the container by children and others unable to recognize the danger. The over cap 30 and under cap 50 have an operable ratchet teeth engagement mechanism requiring a push and turn to overcome the safety feature and permit the opening of the closure 10.

As shown in FIG. 1, container 70 may generally have an elongated cylindrical shape, but it is not limited to such and may be of a variety of shapes that best contain the product or have the greatest aesthetic appeal. As shown in FIG. 1, container 70 has a shoulder narrowing to a container neck finish 73 comprising a neck 76 that is of sufficient length to accommodate an external thread 74 for threaded engagement of child resistant closure 10 with the container. At the top of the neck 76 is an opening 72 surrounded by mouth 75 permitting access to the contents of container 70. Container 70 may be made of unitary construction and made of any numerous materials commonly known in the art depending on specific product and environmental conditions. Some common examples of materials include but are not limited to polyethylene, polypropylene, and polyethylene terephthalate. Container 70 is merely representative of containers in general, and it is to be understood that there are a variety of containers of different shape, size, and neck finish that may be used with the push and turn closure embodiments herein.

Figure 2:
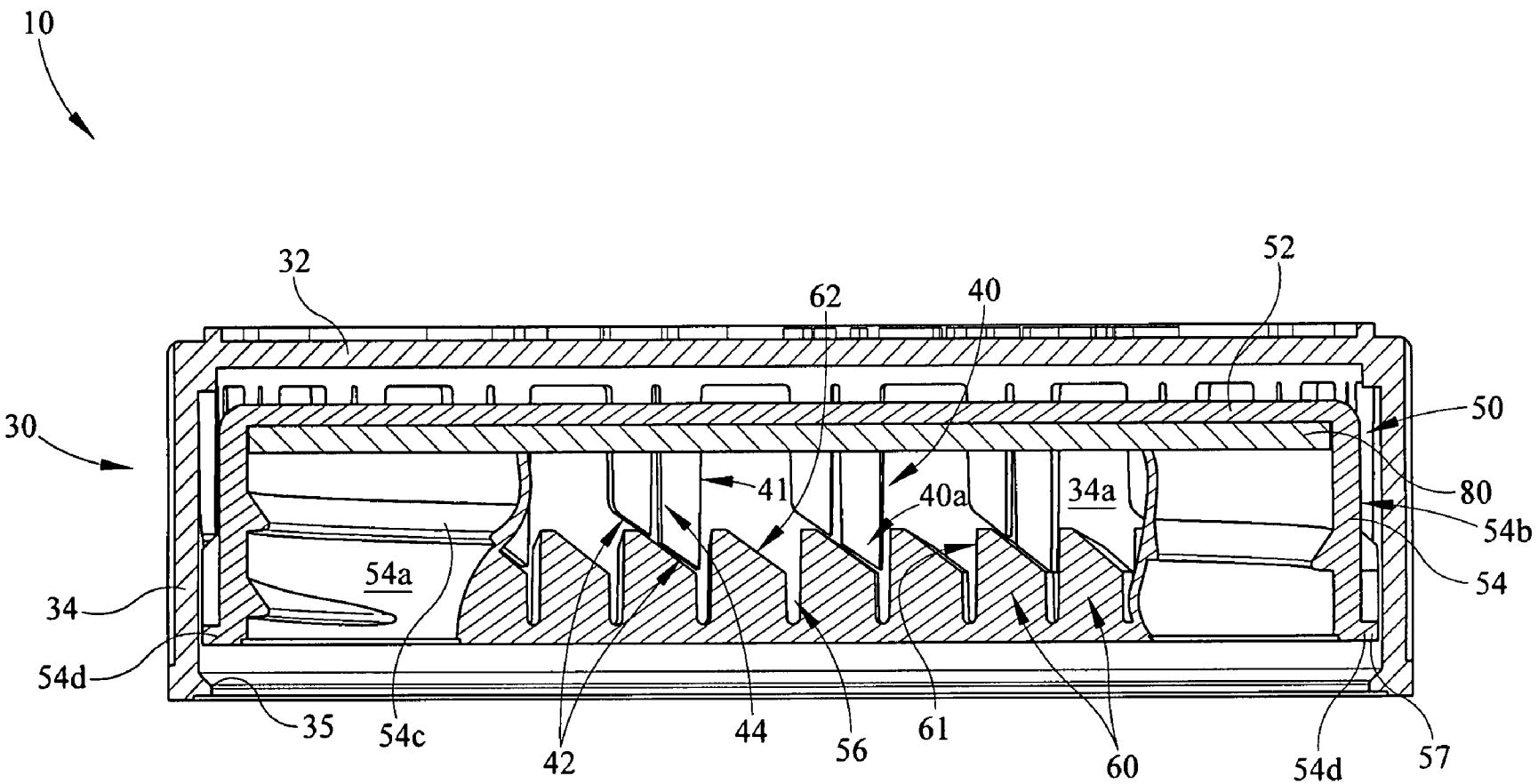
FIG. 2 is a sectional view of the assembled ratchet push and turn closure of FIG. 1 taken along line 2-2 with the under cap partially broken away illustrating the ratchet teeth configuration and interaction between the under cap and the over cap.
Figure 3A:
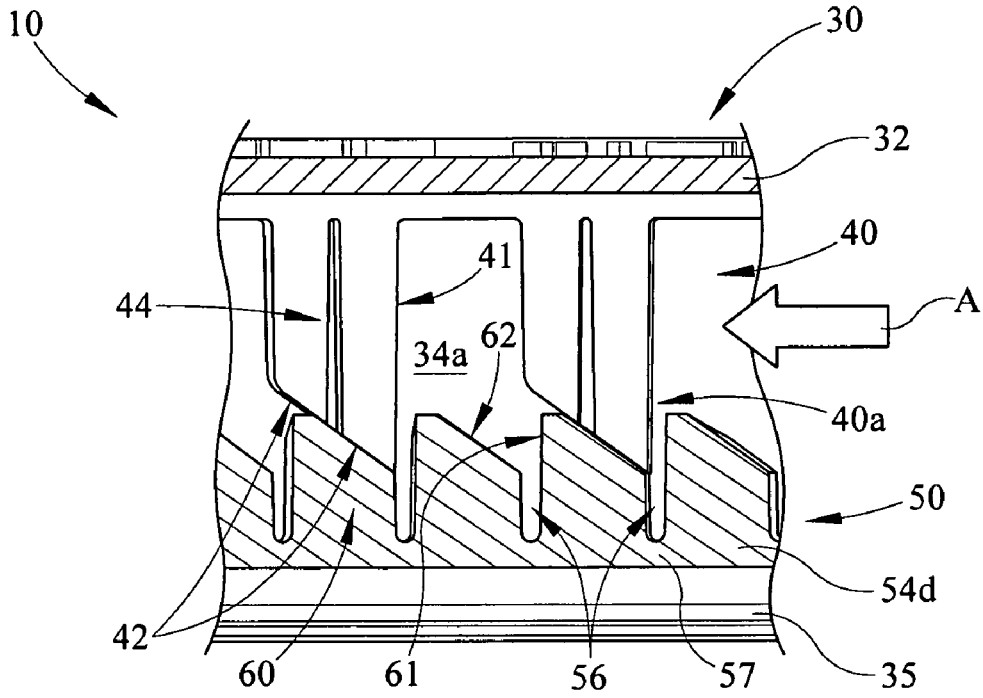
FIG. 3A is an enlarged partial view of the ratchet push and turn closure of FIG. 2 illustrating an off-drive configuration and interaction between the under cap and the over cap.
Figure 3B:
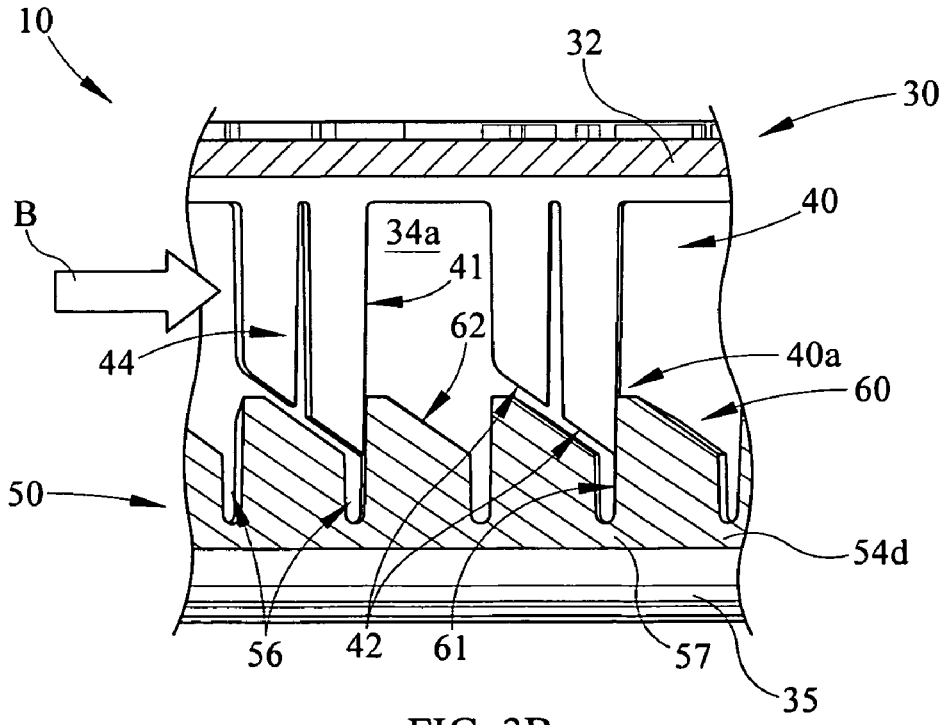
FIG. 3B is an enlarged partial view of the ratchet push and turn closure of FIG. 2 illustrating an on-drive configuration and interaction between the under cap and the over cap.

As shown in FIGS. 1-3B, closure 10 includes an over cap 30. Over cap 30 has a top wall 32 and a peripheral or depending skirt 34 therearound. As shown in FIGS. 2, 3A, and 3B, skirt 34 has a radially inwardly directed retaining rim 35 shaped to hold an under cap 50 within over cap 30 after assembly. At least a portion of an interior surface 34*a* of over cap skirt 34 is provided with a plurality of ratchet teeth 40 arranged about the inner circumference of cap skirt 34. However, the ratchet teeth 40 may project from top wall 32 or interconnect with top wall 32 of over cap 30 as shown in FIG. 2. Each of ratchet teeth 40 of over cap 30 may include an on-drive surface 41 and an off-drive surface 42. An off-drive surface 42 is positioned at a distal free end 40*a* of each of ratchet teeth 40, while each on-drive surface 41 of each of ratchet teeth 40 extends from distal free end 40*a* to a predetermined distance in a direction towards top wall 32 of over cap 30. As shown in FIGS. 2, 3A, and 3B, off-drive surface 42 is sloped or has an angle of inclination relative to the plane of top wall 32.

As shown in FIGS. 1-3B, closure 10 also includes an under cap 50. Under cap 50 includes a top wall 52 with a peripheral or depending skirt 54 therearound. In addition, under cap 50 may include a sealing liner 80 for sealing against the mouth 75 of container 70 when closure 10 is engaged therewith. An interior surface 54*a* of under cap 50 (FIG. 2) includes an internal thread 54*c* for cooperatively engaging against the threaded neck 73 of container 70. At least a portion of an exterior surface 54*b* of under cap skirt 54 includes a plurality of ratchet teeth 60 arranged about the outer circumference of skirt 54. However, the ratchet teeth 60 may project from top wall 52 or project from both top wall 52 and skirt 54 of under cap 50. Under cap 50 is sized to be disposed within over cap 30 and retained therein by rim 35. Skirt 54 of under cap 50 is somewhat shorter than skirt 34 of over cap 30, so that limited axial displacement is possible between the under cap and the over cap. Ratchet teeth 40 of over cap 30 are shaped for operable engagement with ratchet teeth 60 of under cap 50. However, because of the loose mounting of under cap 50 within over cap 30, over cap 30 may be rotated freely with respect to under cap 50 without interengagement of their respective ratchet teeth when the closure members are sufficiently axially displaced from each other.

As shown in FIGS. 1 and 2, liner 80 is sized to nest against the interior surface of top wall 52 of under cap 50. Liner 80 acts as a seal between closure 10 and mouth 75 of container neck finish 73 when closure 10 is engaged with neck finish 73 of container 70. Various types of liners 80 may be used including re-seal liners, liners made of malleable seal materials or air permeable materials, foil seals, or other seals known to those skilled in the art. Alternatively, a plug seal (not shown) may depend from the interior surface of top wall 52 of the under cap 50 and serve to seal-in the contents of container 70 without need for additional liners, malleable seal materials, foil seals or other types of seals for seating the closure in contact with the container neck finish, as is well known in the art.

FIG. 3B shows ratchet teeth 40 of over cap 30 in operable engagement with ratchet teeth 60 of under cap 50 when closure 10 is being engaged with container 70. When minimal force is applied downwardly to over cap 30 while turning it in the closure-applying direction B, distal free ends 40*a* of over cap ratchet teeth 40 engage ratchet teeth 60 of under cap 50 to screw closure 10 onto container neck finish 73. Over cap ratchet teeth 40 are generally trapezoidal in cross-section. The trapezoidal shape may provide strength to ratchet teeth 40 and minimizes shearing of the teeth by the similarly shaped ratchet teeth 60 of under cap 50. In the embodiment shown in FIGS. 2, 3A, and 3B, on-drive surface 41 of ratchet teeth 40 is generally perpendicular to the plane of top wall 32, and off-drive surface 42 is inclined at an angle to that plane. Ratchet teeth 60 of under cap 50 also include a surface 61 generally perpendicular to the plane of under cap top wall 52, and an angled surface 62 inclined to top wall 52. Because on-drive surface 41 is generally perpendicular to the plane of top wall 32, distal free end 40*a* of over cap ratchet teeth 40 may easily make the necessary engagement with the generally perpendicular surface 61 of under cap ratchet teeth 60 upon application of a minimal downwardly directed force to screw closure 10 onto container neck finish 73.

FIG. 3A shows the engagement of ratchet teeth 40 of over cap 30 with the corresponding ratchet teeth 60 of under cap 50 during rotation of the over cap in the closure-removing direction A. The application of a downwardly directed pushing force to over cap 30 while turning it in the closure-removing direction A will produce an effect which depends on the magnitude of the applied force. If the force is great enough, the angled or off-drive surfaces 42 of over cap ratchet teeth 40 will be tightly cammed against angled surfaces 62 of under cap ratchet teeth 60 and the turning of the over cap will operate to unscrew closure 10 from container neck finish 73. If, on the other hand, an insufficient pushing force is applied to over cap 30, as may normally occur when turned by a child, off-drive surfaces 42 will slide along angled surfaces 62 of under cap 50 across the free distal edge of ratchet teeth 60. This sliding motion will, of course, be accompanied by axial displacement of over cap 30 from under cap 50 as angled off-drive surfaces 42 slide up the inclined surfaces 62. The difference in length between skirt 54 of under cap 50 and skirt 34 of over cap 30 allows this axial displacement to occur as successive ratchet teeth 40 of over cap 30 slide over successive ratchet teeth 60 of under cap 50 without imparting a turning movement to the under cap, thus producing the desired child resistant feature.

As shown in FIGS. 2, 3A, and 3B, ratchet teeth 40 of over cap 30 may include a first groove 44. First groove 44 extends axially from distal free end 40*a* to a predetermined distance towards top wall 32. First groove 44 is substantially perpendicular to top wall 32 and may be tapered as is shown within ratchet teeth 40. The depth of first groove 44 within ratchet teeth 40 may vary but is shown as extending to interior surface 34*a* of over cap skirt 34. First groove 44 divides the angled off-drive surfaces 42 of ratchet teeth 40 into a plurality of surfaces, however these multiple surfaces of surface 42 still function together as a camming or off-drive surface. First groove 44 within over cap ratchet teeth 40 serves to reduce the mass of material comprising each tooth thereby reducing the overall weight of over cap 30 or closure 10. Reducing the mass of ratchet teeth 40 also reduces the occurrence of sink marks on the outer periphery of skirt 34 of over cap 30 during the molding process used to produce it. Sink marks occur when an increased mass of material in a particular location of the closure during molding creates imperfections in surrounding areas of the closure due to the increased material shrinkage from the thicker section in the one particular location. Although each first groove 44 is shown in detail in FIGS. 2, 3A, and 3B, it should be understood that first grooves may be a variety of shapes, sizes, positions, and quantities within ratchet teeth 40, and similar grooves (not shown) may also be molded into ratchet teeth 60 for the same purpose, while still allowing the ratchet teeth to operably engage each other as a safety feature.

Figure 6:
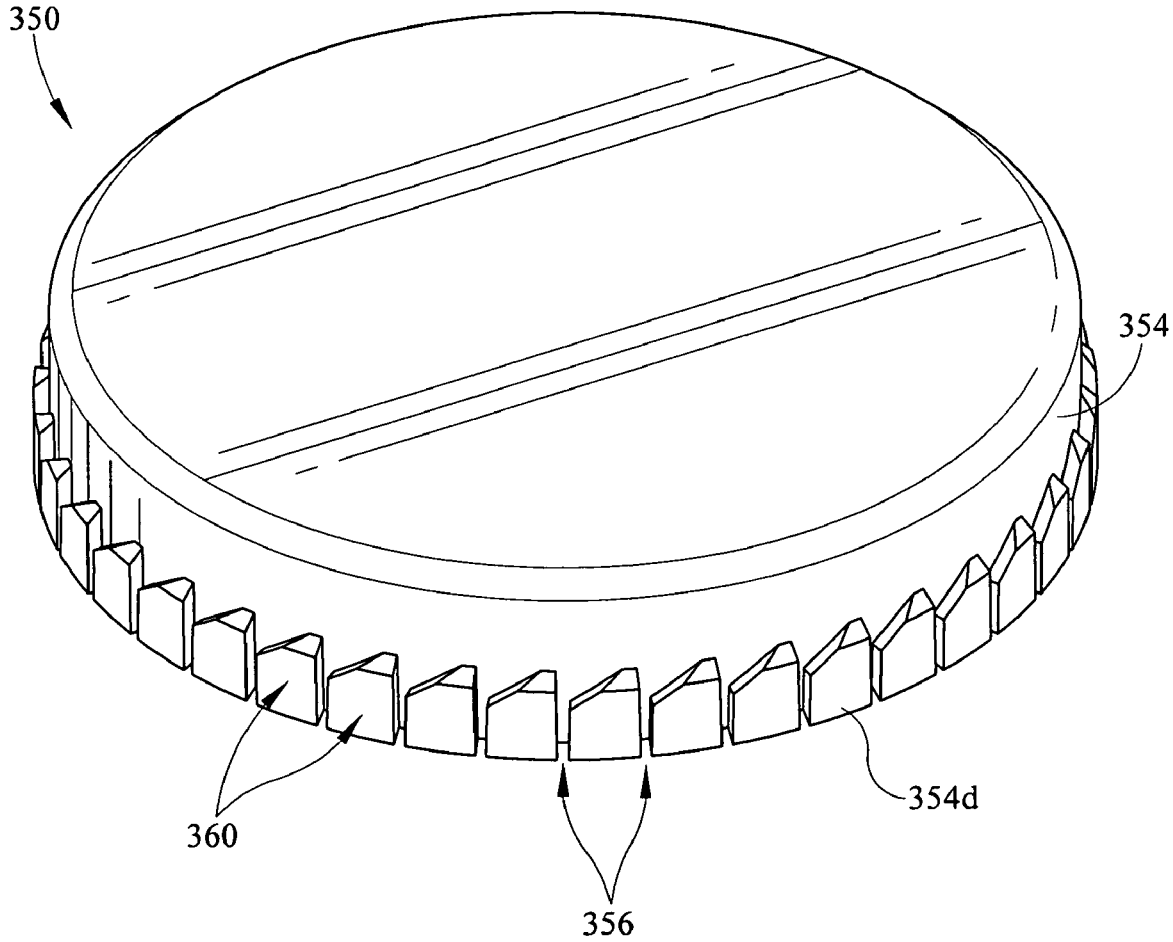
FIG. 6 is an enlarged perspective view of another under cap embodiment.

As shown in FIGS. 1, 2, 3A, and 3B, a second groove 56 may be formed between ratchet teeth 60 to allow for the dissipation of air that may be compressed between over cap 30 and under cap 50 during the assembly process. When child resistant closure 10 is assembled, under cap 50 is fully disposed within over cap 30. A distal end 54*d* of under cap skirt 54 and the retaining rim 35 of over cap skirt 34 normally interfere with each other and must be manually traversed past each other during insertion of under cap 50 within over cap 30. At the point of traversing the interference between the caps 30 and 50, air between over cap 30 and under cap 50 may be compressed, causing resistance to their assembly. Such compressed air is thus preferably evacuated from within during the assembly process. The second grooves 56 of under cap 50 allow such compressed air to escape. By evacuating of the compressed air through second groove 56, the force required to assemble over cap 30 and under cap 50 can be reduced. The second grooves 56 positioned between adjacent ratchet teeth 60 of under cap 50 may extend to a point adjacent to but not through distal end 54*d* of under cap skirt 54, resulting in a continuous outer periphery rim 57 adjacent distal end 54*d*. As shown in FIG. 6 another embodiment of an under cap 350 includes second grooves 356 extending through a distal end 354*d* of under cap skirt 354. Second grooves 356 essentially separate each adjacent ratchet tooth 360 resulting in a discontinuous outer periphery of under cap skirt 354 adjacent distal ends 354*d* of the ratchet teeth. Second groove 56 may be provided in various shapes, sizes, and positions, such as between adjacent ratchet teeth as shown and/or within each ratchet tooth (not shown), and still be within the scope of the embodiments of the invention.

Figure 4A:
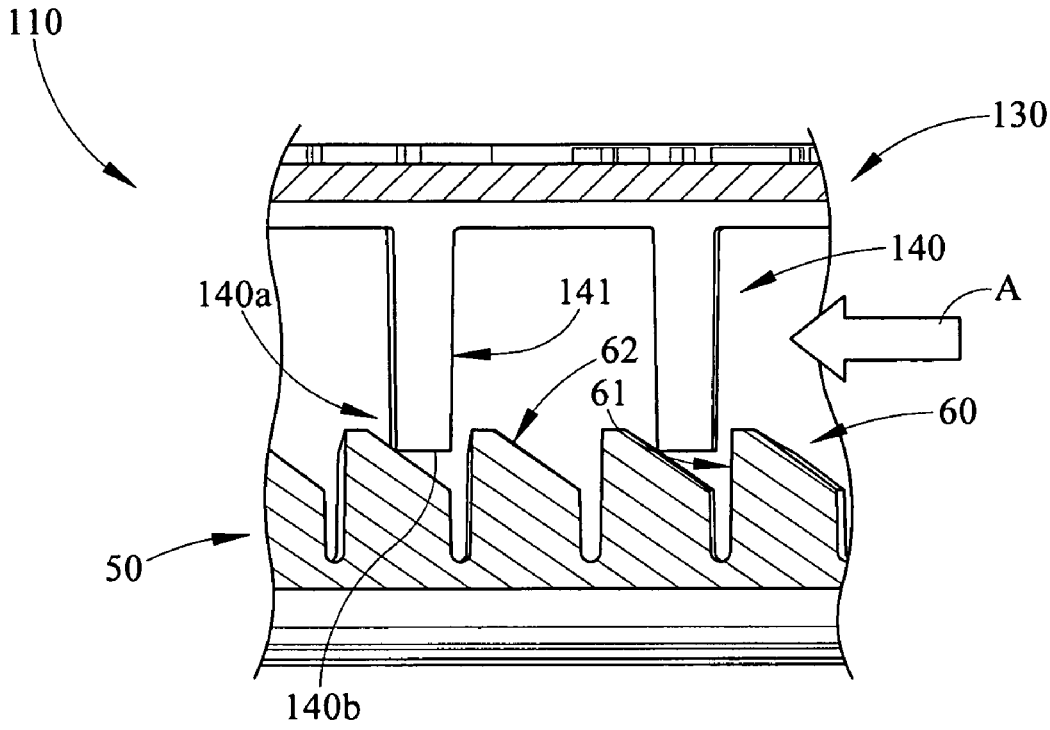
FIG. 4A is an enlarged partial sectional view of another embodiment of an assembled ratchet push and turn closure illustrating an off-drive configuration and interaction between the under cap and the over cap.
Figure 4B:
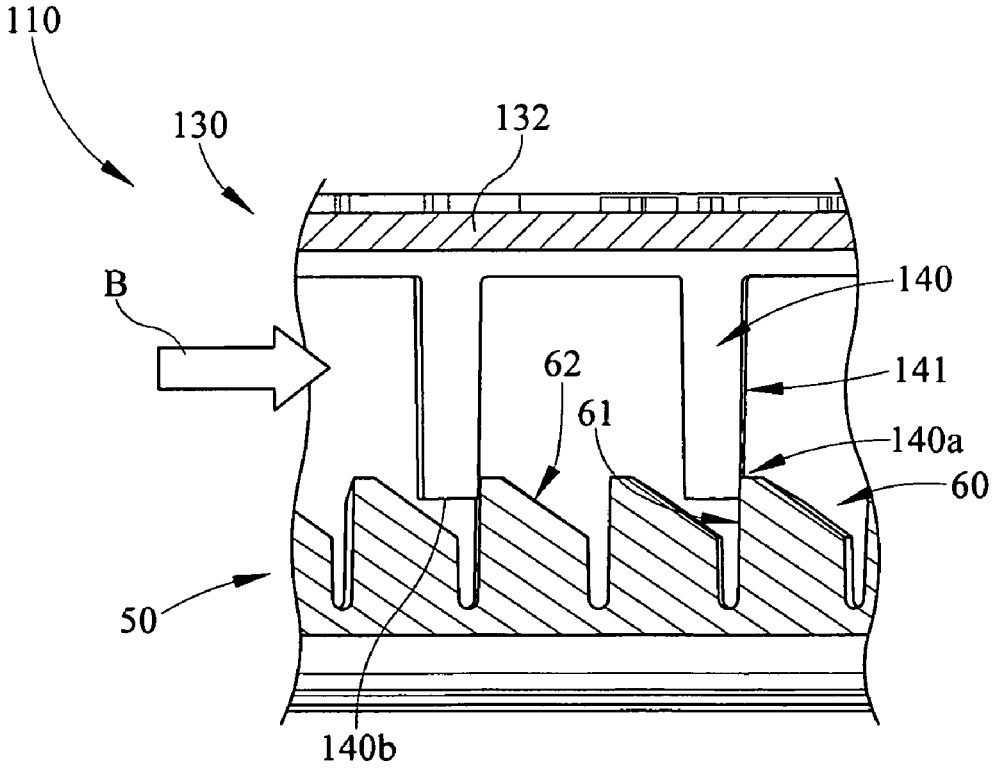
FIG. 4B is an enlarged partial sectional view of the ratchet push and turn closure of FIG. 4A illustrating an on-drive configuration and interaction between the under cap and the over cap.

As shown in FIGS. 4A and 4B, another embodiment of a closure 110 also utilizes a ratchet push and turn mechanism. An over cap 130 of closure 110 includes a plurality of projecting ratchet teeth or ribs 140 each having a distal free end 140*a*. The terminus 140*b* of each distal free end 140*a* is substantially squared-off in contrast to the angled off-drive surfaces 42 of closure 10 in FIGS. 2, 3A, and 3B. As shown in FIG. 4B, over cap rib 140 operably engages a plurality of ratchet teeth 60 of under cap 50 when minimal force is applied downwardly to over cap 130 while turning it in the closure-applying direction B. On-drive surfaces 141 of ratchet teeth 140 are preferably relatively perpendicular to the plane of top wall 132, although they may be angled to a degree. Because on-drive surfaces 141 are relatively perpendicular to the plane of top wall 132, distal free end 140*a* of over cap ratchet teeth 140 may easily make the necessary engagement with the generally perpendicular surface 61 of under cap ratchet teeth 60 upon application of a minimal downwardly directed force, acting to screw closure 110 onto a container neck finish. As shown in FIG. 4A, the application of a downwardly directed pushing force to over cap 130 while turning it in the closure-removing direction A will, as described above for the embodiment of FIG. 2, produce an effect which depends on the magnitude of the applied force. If the force is great enough, a corner of each distal free end 140*a* of each rib 140 will be cammed against the angled surfaces 62 of under cap teeth 60, as shown in FIG. 4A, and the turning of over cap 130 will operate to unscrew closure 110 from the container neck finish. If, on the other hand, an insufficient force is applied, the corners of distal free ends 140*a* will slide along and across adjacent surfaces 62 of teeth 60 of under cap 50 and thus will not cam the free distal edge of ratchet teeth 60. Also as described above with reference to FIGS. 2, 3A, and 3B, rib 140 may also include a groove (not shown) extending from the distal free end 140*a* of the rib to a predetermined distance towards top wall 132 of over cap 130.

Figure 5:
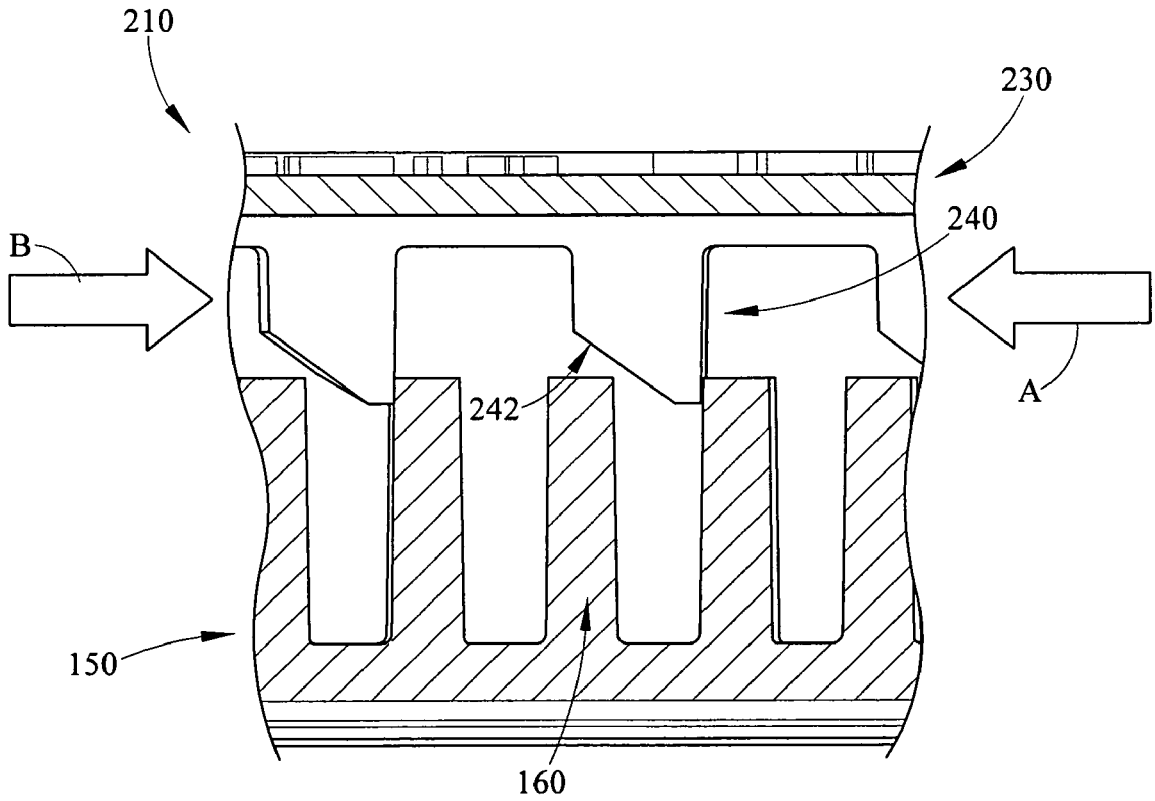
FIG. 5 is an enlarged partial sectional view of another embodiment of a ratchet push and turn closure illustrating an on-drive configuration and interaction between the under cap and the over cap.

Another embodiment of a ratchet push and turn closure 210 is shown in FIG. 5. Here, a plurality of ribs 160, with or without (as shown) grooves, are provided on the skirt outer periphery of under cap 150, while a plurality of teeth 240 which are trapezoidal in cross section are provided on the inner periphery of over cap 230. Ribs 160 do not normally lockingly engage the plurality of ratchet teeth 240 of over cap 230. Over cap 230 and under cap 150 are loosely fitted together. As shown in FIG. 5, turning over cap 230 clockwise in direction B will normally turn under cap 150 and will thread the safety closure 210 onto the container neck finish. Turning over cap 230 in a counterclockwise direction A will not normally turn under cap 150, which is threadably attached to the container neck. Thus, simple counterclockwise rotational motion of over cap 230 will not remove closure 210 from the container. However, a simultaneous counterclockwise rotational force in direction A combined with a sufficient downwardly directed pushing force will overcome the safety feature and permit removal of closure 210 from the container. The downward force causes ratchet teeth 240 with angled surface 242 to lockingly engage ribs 160 of under cap 150, transferring the counterclockwise rotational force applied from over cap 230 to under cap 150 and permitting removal of closure 210 from the container. The ribs 160 or 140 may be provided with first and second grooves as described above, and in a variety of different quantities, positions, shapes, and sizes and still function to appropriately engage the corresponding ratchet teeth of the other cap of the ratchet push and turn closure.

It is understood that while certain embodiments of the invention have been illustrated and described, it is not limited thereto except insofar as such limitations are included in the following claims and allowable functional equivalents thereof.

I claim:

1. A ratchet push and turn child resistant closure comprising:

a first cap operably engaging a second cap, said first cap having a first plurality of ratchet teeth operably engageable with a second plurality of ratchet teeth of said second cap;

at least one of said first plurality of ratchet teeth having a distal free end received within a space between two adjacent said second plurality of second teeth, said distal free end having a ratchet drive surface operably engaging one of said adjacent second plurality of ratchet teeth; and said at least one of said first plurality of ratchet teeth having a first groove extending within said at least one of said first plurality of ratchet teeth from said ratchet drive surface to a predetermined distance away from said distal free end, wherein said first groove intersects said ratchet drive surface in said at least one of said first plurality of ratchet teeth creating two or more drive surfaces in substantially a same plane.

2. The ratchet push and turn child resistant closure as in claim 1 wherein each said two or more drive surfaces of said at least one of said first plurality of ratchet teeth has an angled surface.

3. The ratchet push and turn child resistant closure as in claim 1 wherein each said distal free end of each of said first plurality of ratchet teeth is substantially squared-off.

4. The ratchet push and turn child resistant closure as in claim 1 wherein said first groove of said at least one of said first plurality of ratchet teeth being dimensioned to exclude entry of said second plurality of ratchet teeth within said first groove during operational engagement between said first cap and said second cap.

5. The ratchet push and turn child resistant closure as in claim 1 wherein said first groove extending within said at least one of said first plurality of first teeth is tapered.

6. The ratchet push and turn child resistant closure as in claim 1 wherein said first cap is an over cap and said second cap is an under cap.

7. The ratchet push and turn child resistant closure as in claim 1 wherein said first cap is an under cap and said second cap is an over cap.

8. A child resistant closure comprising:

an under cap operably engaging an over cap, wherein said over cap includes a top wall and a peripheral over cap skirt, and a first plurality of ratchet teeth;

said under cap including a top wall and a peripheral under cap skirt, and a second plurality of ratchet teeth; and at least one of said first plurality of ratchet teeth or said second plurality of ratchet teeth having an internal first groove extending within said at least one of said first plurality of ratchet teeth or said second plurality of ratchet teeth.

9. The child resistant closure as in claim 8 wherein the other one of said at least one of said first plurality of ratchet teeth or said second plurality of ratchet teeth has an internal second groove extending within the other one of said at least one of said first plurality of ratchet teeth or said second plurality of ratchet teeth.

10. The child resistant closure as in claim 8 wherein said at least one of said first plurality of ratchet teeth has said internal first groove.

11. The child resistant closure as in claim 8 wherein said at least one of said second plurality of ratchet teeth has said internal first groove.

12. The child resistant closure as in claim 8 wherein said internal first groove is substantially transverse to an angled drive surface of said at least one of said first plurality of ratchet teeth or said second plurality of ratchet teeth.

13. The child resistant closure as in claim 8 wherein said internal first groove is tapered.

14. The child resistant closure as in claim 8 wherein said internal first groove is substantially perpendicular to either said under cap top wall or said over cap top wall.

15. The child resistant closure as in claim 8 wherein each of said first plurality of ratchet teeth project from at least a portion of an interior surface of said over cap skirt and each of said second plurality of ratchet teeth project from at least a portion of an exterior surface of said under cap skirt.

16. The child resistant closure as in claim 8 wherein the other one of each of said first plurality of ratchet teeth or said second plurality of ratchet teeth is a rib having a distal end being substantially squared-off.

17. A child resistant closure comprising:

an under cap in operable engagement with an over cap;

said over cap including a top wall and a peripheral over cap skirt, a first plurality of ratchet teeth projecting from at least a portion of an interior surface of said over cap skirt, wherein at least one of said first plurality of ratchet teeth includes a first groove substantially perpendicular to said top wall and internally positioned within said at least one of said first plurality of ratchet teeth; and said under cap including a top wall and a peripheral under cap skirt, a second plurality of ratchet teeth projecting from at least a portion of an exterior surface of said under cap skirt.

18. The child resistant closure as in claim 17 wherein each of said first plurality of ratchet teeth or said second plurality of ratchet teeth includes a distal end being substantially angled.

19. The child resistant closure as in claim 18 wherein said first groove extends from adjacent said angled distal end of said at least one of said first plurality of ratchet teeth to a predetermined distance away from said angled distal end within said at least one of said first plurality of ratchet teeth.

20. The child resistant closure as in claim 17 wherein each of said first plurality of ratchet teeth or said second plurality of ratchet teeth is a rib having a distal end being substantially squared-off.

21. The child resistant closure as in claim 17 wherein said exterior surface of said under cap skirt has a second groove, wherein said second groove extends between adjacent said second ratchet teeth through a distal end of said under cap skirt thereby creating a discontinuous outer periphery of said under cap skirt at said distal end of said under cap skirt.

22. The child resistant closure as in claim 21 wherein said second groove extends to adjacent a distal free end of said under cap skirt.

23. The child resistant closure as in claim 17 wherein said first groove is tapered within said at least one of said first plurality of ratchet teeth.

* * * * *